US005155352A

United States Patent [19]

Kim et al.

[11] Patent Number: 5,155,352

[45] Date of Patent: Oct. 13, 1992

[54] OPTICALLY ACTIVATED SUB-NANOSECOND HYBRID PULSER

[75] Inventors: Anderson H. Kim, Toms River; Maurice Weiner, Ocean; Robert J. Youmans, Brick; Robert J. Zeto, Eatontown, all of N.J.; Louis J. Jasper, Jr., Fulton, Md.

[73] Assignee: The United States of America as represented by The Secretary of the Army, Washington, D.C.

[21] Appl. No.: 797,595

[22] Filed: Nov. 25, 1991

[51] Int. Cl.[5] ..... H01V 40/14

[52] U.S. Cl. ..... 250/211 J; 250/551; 357/30

[58] Field of Search ..... 250/211 R, 211 J, 551, 250/208.2, 208.4, 208.6; 307/311; 342/21; 357/30 R, 30 D

[56] References Cited

U.S. PATENT DOCUMENTS

| | | | |
|---|---|---|---|
| H, 695 | 10/1989 | Weiner et al. | 250/211 J |
| 3,917,943 | 11/1975 | Auston | 250/211 J |
| 4,301,362 | 11/1981 | Mourou | 250/211 J |
| 4,822,991 | 4/1989 | Riggs et al. | 250/211 J |
| 4,972,069 | 11/1990 | Grischkowsky | 250/211 J |
| 4,993,033 | 2/1991 | Lin | 372/30 |
| 5,017,793 | 5/1991 | Halsey et al. | 250/551 |
| 5,028,971 | 7/1991 | Kim et al. | 357/30 |
| 5,047,621 | 9/1991 | Weiner et al. | 250/211 J |

*Primary Examiner*—David C. Nelms
*Assistant Examiner*—John R. Lee
*Attorney, Agent, or Firm*—Michael Zelenka; William H. Anderson

[57] ABSTRACT

The combination of a photoconductive switch coupled to an energy storage device wherein the switch is comprised of photoconductive semiconductor material while the energy storage device comprises a radio transmission line including a different material, i.e. a dielectric storage medium. A photoconductive semiconductor gallium arsenide switch is embedded in a circular disc of dielectric material with upper and lower layers of continuous radial metallization configured in a circular pattern located thereon. The upper layer of metallization includes an apertured grid adjacent one surface of the switch, while the outer conductor of a coaxial output signal line is connected to the metallization layer on the opposite side with the inner conductor thereof passing through the dielectric layer to the undersurface of the semiconductor switch. A variation comprises the upper and lower metallization layers being formed in the shape of a plurality of discrete straight line segments or strips which extend radially outward from the center and thus forms a quasi-radial structure.

15 Claims, 3 Drawing Sheets

OPTICALLY ACTIVATED SUB-NANOSECOND HYBRID PULSER

GOVERNMENT INTEREST

The invention described herein may be manufactured, used, and licensed by or for the Government for governmental purposes without the payment to us of any royalty thereon or therefor.

BACKGROUND OF THE INVENTION

1. Field of the Invention

This invention relates generally to electrical pulse signal generators and more particularly to a sub-nanosecond, kilovolt pulse generator for use in impulse radar apparatus, active electromagnetic signal jammers, and relatively high power microwave weapon systems.

3. Description of the Prior Art

In recent years there has been active research activity into the generation of nanosecond type pulses utilizing a high power photoconductive solid state switch coupled to a storage device. One of the critical elements of high power pulse generation with sub-nanosecond pulsewidth is the switch. To generate such pulses, the switch must exhibit a transition from a high resistivity state to a conductive state in a sub-nanosecond time interval. One such switch is disclosed in U.S. Pat. No. 5,028,971 issued to Anderson H. Kim et al on Jul. 2, 1991, and entitled, "High Power Photoconductor Bulk GaAs Switch". The teachings of this patent are intended to be incorporated herein by reference and discloses a photoconductive gallium arsenide (GaAs) switch having two mutually opposite grided electrodes which receives activating light from a laser. When the laser light is applied to the switch, the electrical resistance of the semiconductive material is decreased through electron/hole pairs being generated. This resistance change is translated into a change in the current that flows through an output circuit.

The other critical element in the generation of fast electrical pulses utilizing high power photoconductive solid state switches is the energy storage element. Depending on the structure, it produces not only sub-nanosecond pulsewidth, but also voltage enhancement.

In general, two techniques are used to generate and deliver fast rise time, high power pulses to a load impedance The first technique utilizes the recombination property of the semiconductor material from which the switch itself is fabricated The pulses generated with this technique using photoconductive GaAs switches typically have a long pulsewidth with a relatively long recovery time at high bias voltage. This is due to the substantially long recombination time and the switch lock-on phenomenon exhibited by gallium arsenide In the second approach, the output pulsewidth is controlled by the energy storage element which may comprise either a short section of transmission line or capacitor which delivers all or substantially most of the stored energy to the load so that only a closing photoconductive switch is required.

SUMMARY

Accordingly, it is the principal object of the present invention to provide an improvement in the generation of relatively narrow pulsewidth high power pulses.

It is a further object of the present invention to provide an improvement in optically activated nanosecond kilovolt pulse generators.

And it is yet another object of the invention to provide an optically activated hybrid pulse generator for the generation of sub-nanosecond pulses of relatively high amplitude.

The foregoing and other objects of this invention are realized by the combination of a photoconductive switch coupled to an energy storage device wherein the switch is comprised of photoconductive semiconductor material, while the energy storage device comprises a radio transmission line including a different material, i.e. a dielectric storage medium. In one embodiment of the invention, a semiconductor gallium arsenide switch is embedded in a circular disc of dielectric material with upper and lower layers of continuous radial metallization configured in a circular pattern located thereon. The upper surface of metallization includes an apertured grid adjacent one surface of the switch, while the outer conductor of a coaxial output signal line is connected to the metallization layer on the opposite side with the inner conductor thereof passing through the dielectric layer to the undersurface of the semiconductor switch. In a second embodiment of the invention, the upper and lower metallization layers are formed in the shape of a plurality of discrete straight line segments or strips which extend radially outward from the center and thus form a quasiradial structure. This produces a large capacitance for a given finite physical dimension of the energy storage element and a voltage amplitude enhancement results at the load. By triggering this pulser with fast risetime laser light, a high amplitude pulse with sub-nanosecond pulsewidth is produced This type of configuration produces a large capacitance for a given finite physical dimension of the energy storage element and a voltage amplitude enhancement at the load results. By triggering a pulser in accordance with the present invention with fast risetime laser light, a high amplitude pulse of sub-nanosecond pulsewidth is produced.

BRIEF DESCRIPTION OF THE DRAWINGS

The following detailed description of the invention will be more readily understood when considered together with the accompanying drawings in which.

DETAILED DESCRIPTION OF THE INVENTION

Figure 1:
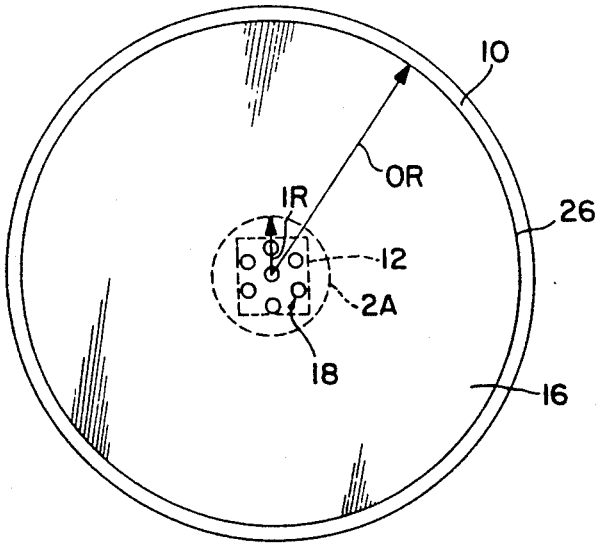
FIG. 1 is a top planar view illustrative of a first embodiment of the invention.
Figure 2A:
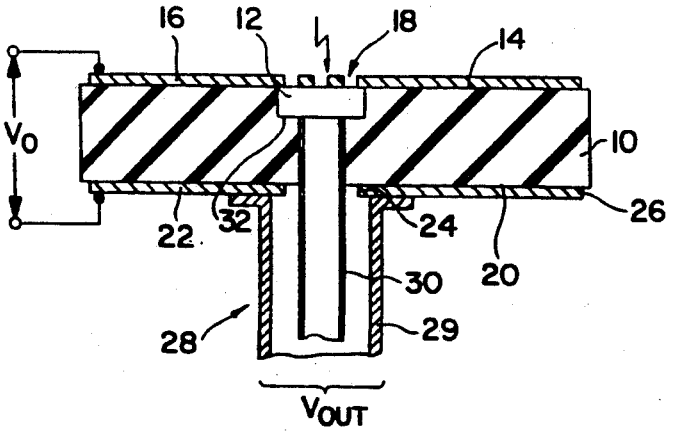
FIGS. 2A and 2B, are central cross sectional views of two versions of the embodiment shown in FIG. 1.

Referring now collectively to the drawings, reference numeral 10, for example, denotes a generally flat circular disc (FIG. 1) of dielectric material of constant thickness having a photoconductive bulk semiconductor switch 12 centrally imbedded in the upper surface 14 as shown in FIG. 2A. The switch 12 comprises a semi-insulating gallium arsenide (GaAs) optically activated switch device such as taught in the aforementioned U.S.

Pat. No. 5,028,971. On the upper surface 14 of the dielectric member 10 there is formed a high voltage conducting plate 16 comprising a layer of metallization which includes an apertured grid 18 for coupling of laser energy from an optical activating source, not shown to the switch 12. Typically, the laser light comprises a 1.06 micron wavelength light generated, for example, by a neodymium doped yttrium aluminum garnet (Nd:YAG) laser. As shown in FIG. 2A, the laser light is introduced in the center portion of the semiconductor switch 12.

On the undersurface 20 of the dielectric disc 10 is formed a second high voltage conducting plate 22, also comprised of a layer of metallization. The plate 22 opposes the top plate 16 and is annular in configuration defined by the inner and outer edges 24 and 26 and having an inside diameter IR and an outside diameter OR.

Figure 2B:
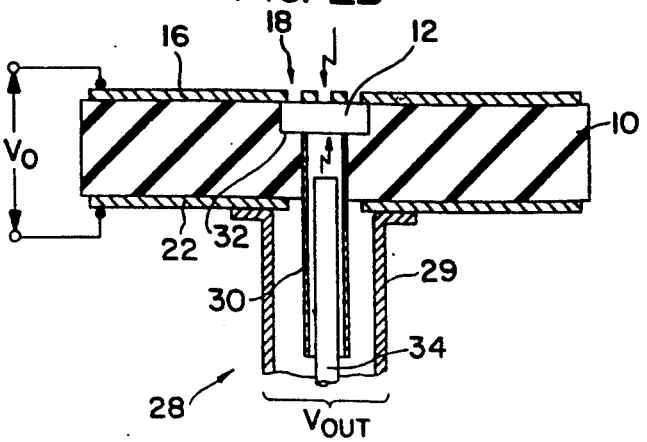

Further as shown in FIG. 2A, a bias voltage $V_o$ is connectable across the metallization layers 16 and 22 for charging the electrical capacitor formed by the layers of metallization 16 and 22 and the dielectric member 10. A coaxial output transmission line 28 is connected to the device and is comprised of an outer conductor 29 and an inner conductor 30. Both coaxial members 29 and 30 are generally cylindrical in cross section, with the outer conductor 29 being bonded to the metallization layer 22. The inner conductor 30 is shown passing through the underside 20 of the dielectric disc 10 to lower surface 32 of the semiconductor switch 12. In the configuration shown in FIG. 2A, laser light is introduced to only one side of the semiconductor switch 12 through the grid 18, while in FIG. 2B the same configuration includes an optical fiber member 34 fed through the inner conductor 30 for the additional introduction of laser light to the underside of the optically activated switch 12. The hybrid pulser as shown in FIG. 1, FIG. 2A and 2B combines the GaAs photoconductive switch 12 with the dielectric medium 10 covered by the conducting medium of the metallization layers 16 and 22 and wherein electrical energy is stored upon the application of the bias voltage $V_o$. The shape of the energy storage medium is radial due to the configuration of the metallization layers 16 and 22 and the characteristic impedance of the pulser as determined by the ratio between the inner diameter IR and the outer diameter OR of the lower layer 22.

Switching takes place at the center of the structure where the semiconductor switch 12 makes contact with both the upper layer of metallization 16 and the inner conductor 30 of the output coaxial line 28. When laser light impinges on the center portion of the GaAs switch 12, photon generated carriers in the bulk semiconductor material reduces the resistivity of the switch 12 so that the inner conductor 30 is electrically connected to the top metallization plate 16. When this occurs, electrical energy stored in the capacitance defined by dielectric medium 10 and the two conducting plates of metallization 16 and 22 is delivered to the coaxial output line 28 in the form of traveling waves. With the introduction of triggering laser light to the underside of the semiconductor switch 12 as shown in FIG. 2B, the switching characteristic is enhanced due to increase in laser light energy delivered to the switch.

Figure 3:
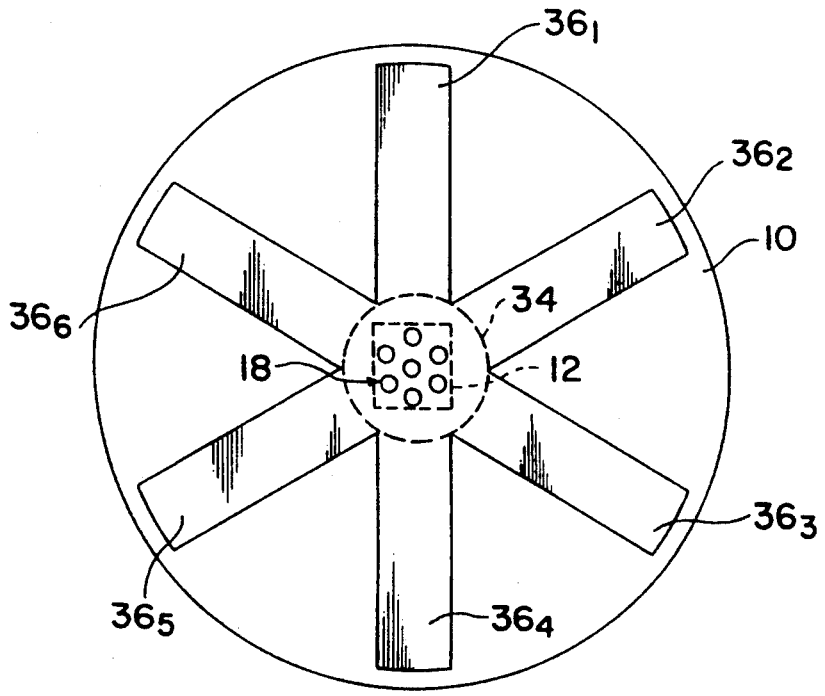
FIG. 3 is a top planar view of a second embodiment of the invention.

A second embodiment of the invention comprising a quasi-radial configuration is disclosed in FIG. 3 and differs from the first embodiment in that the substantially continuous surfaces of metallization 16 and 22 are now replaced by a plurality of outwardly directed parallel microstrip linear line segments, the top members being shown in FIG. 3 by reference numerals $36_1$, $36_2$ . . . $36_6$. Like line segments, not shown, are located on the underside of the circular dielectric member 10. Since the multiple strip lines are now connected in parallel at the center of the structure where the switch 12 is located, the coupling between microstrip lines $36_1$ . . . , $36_6$ produces an impedance change as the wave propagates towards the center of the structure when the GaAs switch 12 is activated. It should be noted that with the reduction in the amount of metallization, the impedance transformation of the configuration shown in FIG. 3 is substantially smaller than the pulser using a radial transmission line as shown in FIG. 1

As noted above, initially the capacitance formed between the dielectric medium and the metallization formed on either side thereof is charged with the voltage $V_O$. When the laser light is applied to the switch 12, electron-hole pairs are generated by incoming photons. These photon-generated conduction carriers start to sweep across the active switch area and produce electrical pulses which are coupled to a load impedance, not shown, via to the coaxial transmission line 28. One important feature of a pulser configured as shown is one of voltage enhancement which is produced at the load impedance.

Figure 4:
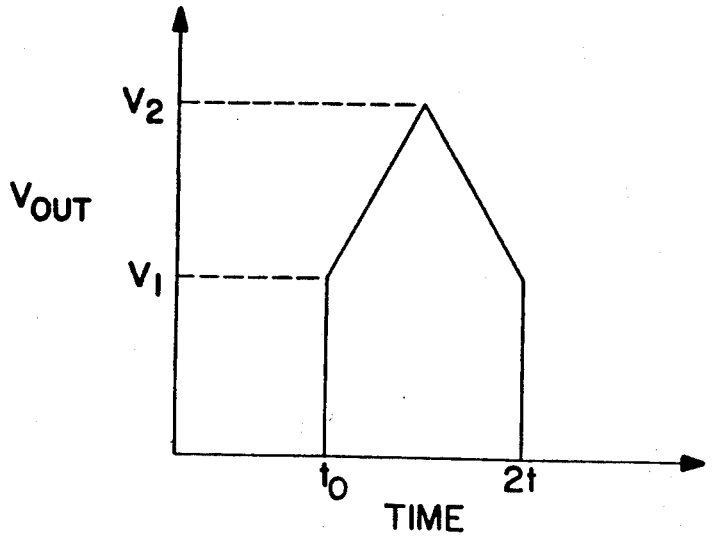
FIG. 4 is a curve illustrative of an ideal output waveform generated by the subject invention.

A complete circuit analysis requires taking into account the radial impedance transformation, dispersion, and the transient properties of the switch 12. If one neglects such factors as the reflection in the radial transmission region, dispersion effects, the exact transition behavior in the switch, etc., one can make very simple approximations for the voltage amplitude transformation If one assumes an ideal switch in a matched impedance condition, an ideal waveform would be generated as shown in FIG. 4, for example, where the voltage, $$V_1 = V_O Z_O / (Z_{IR} + Z_o + R_s), \quad (1)$$

appears as $V_{out}$ across the coaxial line 28 when the switch becomes conductive at to, a voltage enhancement occurs to the magnitude of, $$V_2 = [V_o Z_o / (Z_{IR} + Z_o + R_s)][Z_{IR} / Z_{OR}]^{\frac{1}{2}}, \quad (2)$$

where $Z_{IR}$ and $Z_{OR}$ are the impedances in the radial transmission line at the inner and outer diameters IR and OR, respectively, $Z_O$ is the impedance of the coaxial line 28, $R_S$ is the equivalent resistance in the semiconductor of the switch 12 and $V_o$ is the applied bias voltage The terms in the first bracket are identical to that of a uniform transmission line with an impedance $Z_{IR}$. The square root term expresses the voltage transformation property as the wave proceeds towards the center of the radial line.

A specific example of a structure in accordance with this invention has been fabricated and tested and is comprised of a semi-insulating GaAs switch, 5 mm thick and 2.4 cm wide, situated at the center of the device. The dielectric medium consists of an acrylic material with a dielectric constant of 2.65. The outer and inner diameters of the bottom layer of metallization are 25 cm and 5 cm, respectively The height between the conducting planes, i.e., the thickness of the dielectric member is 3 cm and the metallization is comprised of the conventional Au, Ge and Ni formulation used with n-type GaAs material.

Figure 5A:
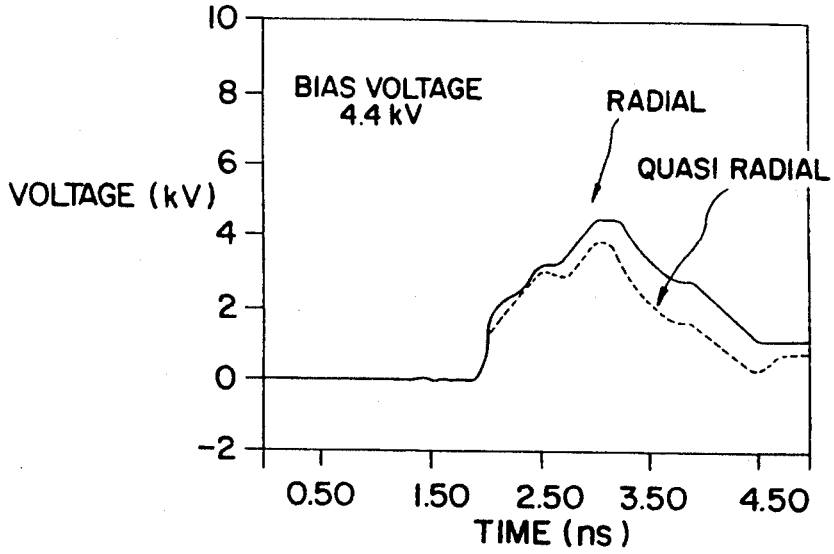
FIGS. 5A. through 5C are a set of typical actual output waveforms generated for three different values of applied bias voltages.
Figure 5B:
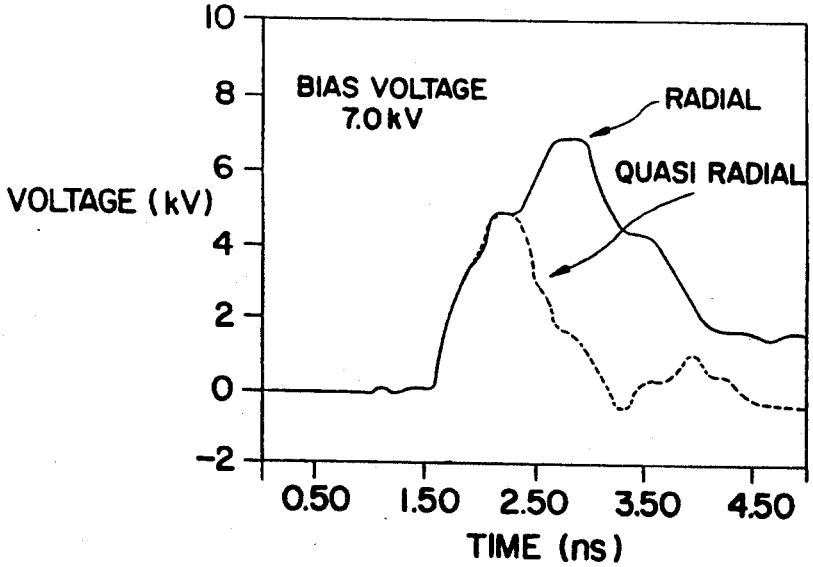
Figure 5C:
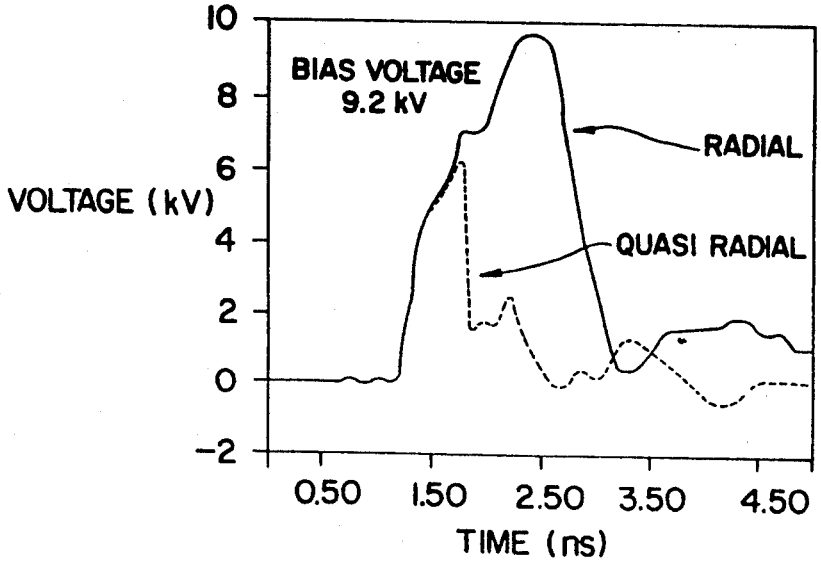

Output waveforms of actual radial and quasi-radial structures constructed as noted above provided waveforms for three different bias voltages, i.e. 4.4 kV, 7.0 kV, and 9.2 kV as shown in FIGS. 5A-5C when a 75 pico-second wide pulse was applied from a mode locked Nd:YAG laser. The observed voltage gains were approximately 2.2 and 1.5 for the radial and quasi-radial line configurations, respectively. These gains include any additional amplitude enhancement caused by positive impedance mismatch. This mismatch appears to be more pronounced in the case of the radial line configuration; however, it should be noted that for the particular bias voltage applied, the quasi-radial configuration of FIG. 3, although providing a relatively lower amplitude output, generates a relatively narrower output pulse.

Thus what has been shown and described is a relatively simple nanosecond pulse generator utilizing radial transmission lines in which a gallium arsenide photoconductive switch and the dielectric medium between two conducting planes are combined into a single integrated structure and where the pulse amplitude delivered to a match load can approach or even exceed the value of the charging voltage applied.

Having thus shown and described what is at present considered to be the preferred embodiments of the invention, it should be noted that the same has been made by way of illustration and not limitation Accordingly, all modifications, alterations and changes coming within the spirit and scope of the invention as set forth in the appended claims are herein meant to be included.

What is claimed is:

1. A pulse signal generator comprising:

an electrical energy storage device coupled to a source of electrical voltage and including a transmission line comprised of a dielectric medium sandwiched between upper and lower radial type electrical conductors which are disposed parallel to each other; and a photoconductive semiconductor switch coupled to said energy storage element and centrally located beneath said upper conductor, said switch becoming conductive upon the application of a predetermined type of light energy so as to cause a high amplitude, narrow output pulse of nanosecond pulsewidth dimensions to be generated at the radial center of said upper and lower radial type conductors, and wherein said upper conductor includes aperture means thereat for the application of light energy to said switch.

2. The pulse signal generator according to claim 1 and further comprising coaxial transmission line means coupled to one of said electrical conductors and said photoconductive switch for coupling said output pulse to a load.

3. The pulse signal generator according to claim 2 wherein said coaxial transmission line means includes a first conductor coupled to said photoconductive switch and a second conductor coupled to said lower conductor, said switch becoming conductive by the application of said light energy to couple said first conductor to said upper conductor.

4. The pulse signal generator according to claim 3 wherein said photoconductive semiconductor switch comprises a semiconductor switch device embedded in said dielectric medium.

5. The pulse signal generator according to claim 4 wherein said semiconductor switch device is comprised of bulk type GaAs.

6. The pulse signal generator according to claim 4 wherein said upper and lower conductors comprise respective outer layers of metallization.

7. The pulse signal generator according to claim 6 wherein said upper and lower layers of metallization comprise continuous circular patterns of metallization.

8. The pulse signal generator according to claim 7 wherein said upper layer comprises a circular layer of metallization including a set of light apertures at the center and said lower layer comprises an annular circular layer having an inside diameter defining a central opening and an outside diameter defining the periphery of the energy storage device.

9. The pulse signal generator according to claim 8 wherein said dielectric medium comprises a circular disc of dielectric material.

10. The pulse signal generator according to claim 8 wherein said first conductor of said coaxial transmission line means comprises an inner conductor passing through said central opening and said dielectric medium to said semiconductor switch device and said second conductor of said coaxial transmission line means comprises an outer conductor coupled to said lower layer of metallization.

11. The pulse signal generator according to claim 6 wherein said upper and lower layers of metallization comprise a plurality of opposing parallel upper and lower conductor segments mutually joined and projecting radially outward from an inner end portion thereof.

12. The pulse signal generator according to claim 10 wherein said conductor segments comprise plural upper and lower linear conductor segments joined at a respective common inner central region of said device.

13. The pulse signal generator according to claim 12 wherein said common inner control region of said upper conductor segments includes a set of light apertures and said common inner region of said lower conductor segments include a central opening therein to said dielectric medium.

14. The pulse signal generator according to claim 12 wherein said first conductor of said coaxial transmission line means comprises an inner conductor passing through said central opening and said dielectric medium to said semiconductor switch device and said second conductor of said coaxial transmission line means comprises an outer conductor coupled to said lower conductor segments.

15. The pulse signal generator according to claim 13 wherein all of said line conductor segments comprise metallization layer segments of equal length and width.

* * * * *